US006364927B1

(12) United States Patent
Narasimhan et al.

(10) Patent No.: US 6,364,927 B1
(45) **Date of Patent: *Apr. 2, 2002**

(54) METAL-BASED POWDER COMPOSITIONS CONTAINING SILICON CARBIDE AS AN ALLOYING POWDER

(75) Inventors: Kalathur S. Narasimhan; Nikhilesh Chawla, both of Moorestown, NJ (US)

(73) Assignee: Hoeganaes Corporation, Cinnaminson, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/557,249

(22) Filed: Apr. 24, 2000

Related U.S. Application Data

(63) Continuation-in-part of application No. 09/480,187, filed on Jan. 10, 2000, which is a continuation-in-part of application No. 09/390,054, filed on Sep. 3, 1999, now abandoned.

(51) Int. Cl.[7] ..... C22C 33/02; C22C 38/02
(52) U.S. Cl. ..... 75/252; 419/38; 419/17
(58) Field of Search ..... 419/17, 38; 75/252

(56) References Cited

U.S. PATENT DOCUMENTS

| | | | | |
|---|---|---|---|---|
| 4,483,905 | A | 11/1984 | Engström | 428/570 |
| 4,676,831 | A | 6/1987 | Engström | 75/252 |
| 4,834,800 | A | 5/1989 | Semel | 106/406 |
| 5,069,714 | A | 12/1991 | Gosselin | 75/252 |
| 5,108,493 | A | 4/1992 | Causton | 75/255 |
| 5,290,336 | A | 3/1994 | Luk | 75/231 |
| 5,298,055 | A | 3/1994 | Semel et al. | 75/252 |
| 5,330,792 | A | 7/1994 | Johnson et al. | 427/217 |
| 5,368,630 | A | 11/1994 | Luk | 75/252 |
| 5,484,469 | A | 1/1996 | Rutz et al. | 75/252 |
| 5,498,276 | A | 3/1996 | Luk | 75/252 |
| 5,538,684 | A | 7/1996 | Luk et al. | 419/66 |
| 5,624,631 | A | 4/1997 | Luk | 419/23 |
| 5,641,922 | A * | 6/1997 | Shivanath et al. | 75/231 |
| 5,902,373 | A | 5/1999 | Vannman et al. | 75/352 |
| 6,019,937 | A | 2/2000 | Shivanath et al. | 419/14 |

FOREIGN PATENT DOCUMENTS

| | | |
|---|---|---|
| WO | WO 99/20689 | 4/1999 |

OTHER PUBLICATIONS

Klein, A.N. et al., "High Strength Si–Mn–Alloyed Sintered Steels," *Powder Metallurgy International*, 1985, 17(1), 13–16.

Klein, A.N. et al., "High Strength Si–Mn Alloyed Sintered Steels," *Powder Metallurgy International*, 1985, 17(2), 71–74.

Mitchell, S.C. et al., "Microstructure and Mechanical Properties of Mn–Cr–Mo–C Steels Sintered at >1140C," *1999 International Conference on Powder Metallurgy & Particulate Materials*, Jun. 20–24, 1999, 1–15.

Salak, A., "Iron–Based Sintered Materials," in *Ferrous Powder Metallurgy*, 1990, 235–237.

(List continued on next page.)

*Primary Examiner*—Daniel J. Jenkins
(74) *Attorney, Agent, or Firm*—Woodcock Washburn LLP

(57) ABSTRACT

Metallurgical powder compositions are provided that include silicon carbide to enhance the strength, ductility, and machine-ability of the compacted and sintered parts made therefrom. The compositions generally contain a metal powder, such as an iron-based or nickel-based powder, that constitutes the major portion of the composition. Silicon carbide is blended with the metal powder, preferably in the form of a silicon carbide powder. Optionally, common alloying powders, lubricants, binding agents, and other powder metallurgy additives can be blended into the metallurgical composition. The metallurgical powder composition is used by compacting it in a die cavity to produce a "green" compact that is then sintered, preferably at relatively high temperatures.

39 Claims, 1 Drawing Sheet

OTHER PUBLICATIONS

Aksas, H.P., et al., "A dilatometric study of sintering iron–VC, WC composites," from *Modern Developments in Powder Metallurgy*, Proceedings of the 1980 International Powder Metallurgy Conference, Jun. 22–27, 1981, 14, 335–345.

Banerjee, S., et al., "New results in the master alloy concept for high strength sintered steels", from *Modern Developments in Powder Metallurgy*, Proceedings of the 1980 International Powder Metallurgy Conference, Jun. 22–27, 1981, 13, 143–157.

Kaufman, S.M., "The use of master alloys for producing low alloy P/M steels," from *Modern Developments in Powder Metallurgy*, Proceedings of the 1976 International Powder Metallurgy Conference, 1977, 10, 1–13.

Pandey. O.P., et al., "Production and characterization of rapidly solidified powders of A1–Si alloys," *PMI*, 1991, 23(5), 291–295.

Šalak, A., "High–strength sintered manganese steel," from *Modern Developments in Powder Metallurgy*, Proceedings of the 1980 International Powder Metallurgy Conference, Jun. 22–27, 1981, 13, 183–201.

Smarsly, W., et al., "Microstructure and texture of combined die forged (CDF) prealloyed Ti–6A1–4V powder compacts," 1985, 17(2), 63–67.

Thümmier, et al., "Sintered steels with high content of hard phases: a new class of wear resistant materials," *Power Metallurgy*, 1991, 23(5), 285–290.

Zapf, G., et al., "Introduction of high oxygen affinity elements maganese, chromium and vanadium in the powder metallurgy of P/M parts," from *New Perspective in Powder Metallurgy*, 1990, 9, 129–156.

Šalak, A., et al., Ferrous Powder Metallurgy, *Cambridge International Science Publishing*, 1995, 4 pages.

Kalogeropoulou, S., et al., "Relationship between wettability and reactivity in Fe/SiC system," *Acta Metall. Mater.*, 1995, 0956–7151(94)00336–X, 43(3), 907–912.

* cited by examiner

METAL-BASED POWDER COMPOSITIONS CONTAINING SILICON CARBIDE AS AN ALLOYING POWDER

This application is a continuation-in-part of application Ser. No. 09/480,187 filed Jan. 10, 2000, now allowed which is a continuation-in-part of 09/390,054 filed Sep. 3. 1999 abandoned.

FIELD OF THE INVENTION

This invention relates to iron-based, metallurgical powder compositions, and more particularly, to powder compositions that include alloying elements in particulate or powder form for enhancing the strength characteristics of resultant compacted parts.

BACKGROUND OF THE INVENTION

Iron-based particles have long been used as a base material in the manufacture of structural components by powder metallurgical methods. The iron-based particles are first molded in a die under high pressures to produce the desired shape. After the molding step, the compacted or "green" component usually undergoes a sintering step to impart the necessary strength to the component.

The strength of the compacted and sintered component is greatly increased by the addition of certain alloying elements, usually in powder form, to the iron-based powder. Commonly used powder metallurgical compositions contain such alloying elements as carbon (in the form of graphite), nickel, copper, manganese, molybdenum, and chromium, among others. The level of these alloying elements can be as high as about 4–5 percent by weight of the powder composition. At the levels used, the cost associated with these alloying element additions can add up to a significant portion of the overall cost of the powder composition. Accordingly, it has always been of interest in the powder metallurgical industry to try to develop less costly alloying elements or compounds to reduce and/or replace entirely the commonly used alloying elements.

Furthermore, although highly useful, some of these alloying elements have undesired properties as well. For example, certain parts manufacturers desire to limit the amount of copper and/or nickel used in the powder metallurgy compositions that are used to form compacted parts due to the environmental and/or recycling regulations that regulate the use or disposal of those parts. The use of graphite is sometimes disadvantageous because it easily dusts out of the powder composition, leading to reduced performance of the compacted part due to the absence of the required amount of carbon for the powder mix.

The inclusion of alloying elements into the powder composition may either enhance or diminish the final part's ductility, that is, the ability of the part to retain its shape after a strain is applied and removed. Certain parts applications require relatively good ductility properties for the final parts. Copper and nickel-containing powder metallurgy parts have low ductility and thus pose certain design constraints. Typically, the range of ductility for such parts is between 1.5 and 2 percent per inch. In certain applications, however, it is desirable for a powder metallurgy part to have ductilities in excess of 3 percent per inch.

As reported in the text *Ferrous Powder Metallurgy*, (1995), attempts have been made in the past, particularly work conducted by A. N. Klein et al., to use silicon as an alloying element to replace such alloying elements as copper, nickel, and molybdenum. The silicon was added to the iron powder in the elemental form, in the form of ferroalloys, or in special ternary FeSiMn master alloy formed by silicides. The use of silicon was found, however, to lead to excessive shrinkage of binary Fe—Si compacts in the range of usual compositions and compaction/sintering conditions. Elemental silicon powder typically has a silicon dioxide rich surface that is difficult to reduce back to silicon in sintering environment commonly used in the manufacture of powder metal parts. In addition, ferroalloys containing silicon are not compressible during molding and thus produce parts having inadequate sintered densities.

There exits a current and long felt need in the powder metallurgical industry to develop alternatives to the use of, or decrease the amount of, various common alloying elements in the powder mixes, such as copper and nickel. Any suitable alternative should be easily blended with the iron-based powder, and improve the strength and/or ductility characteristics of the compacted parts without significantly deteriorating various other powder or compacted part properties.

SUMMARY OF THE INVENTION

The present invention provides metallurgical powder compositions comprising as a major component a powder metallurgy base metal powder, such as iron-based and/or nickel-based powders, to which is blended a silicon carbide-containing powder. The silicon carbide-containing powder has been found to surprisingly enhance the strength and ductility of the final, sintered, compacted parts made from the metallurgical powder compositions. The properties of the final part have been found to be significantly improved if the "green" compacted part is sintered at temperatures above about 2150° F., preferably above about 2200° F., more preferably above about 2250° F., and even more preferably above about 2300° F.

The metallurgical powder compositions generally contain at least about 85 percent by weight of a powder metallurgy base metal powder such as an iron-based powder or a nickel-based powder. A silicon carbide-containing powder is also present in the metallurgical powder compositions in an amount to provide from about 0.05 to about 7.5 percent by weight silicon carbide.

Preferably, the base metal powder is an iron-based powder or combination of such powders having a particle size distribution commonly used in the powder metallurgical industry. The base metal powder is most preferably an atomized metal powder, such as an atomized iron-based powder.

The silicon carbide is preferably blended into the composition as a silicon carbide powder that is at least about 90, more preferably at least about 95 percent pure silicon carbide. However, the silicon carbide-containing powder may be a binary, tertiary, etc. alloy of the silicon carbide with other powders used in metallurgical powder compositions. Alternatively, the silicon carbide-containing powder can be bonded, e.g., diffusion bonded, to the base metal powder, e.g., iron-based powder. The silicon carbide powder preferably has a particle size distribution such that it has a $d_{50}$ value of below about 75 or 50 microns as determined by laser light scattering techniques, and may be angular, rectangular, needle-shaped, spherical, or any other shape.

The metallurgical powder compositions can optionally also contain any of the various other additives commonly used in such compositions. For example, the compositions can contain lubricants, binding agents, and other alloying elements or powders such as copper, nickel, manganese, and graphite.

The present invention also provides methods for the preparation of these metallurgical powder compositions and also methods for forming compacted and sintered metal parts from such compositions, along with the products formed by such methods.

DETAILED DESCRIPTION OF THE INVENTION

Figure 1:
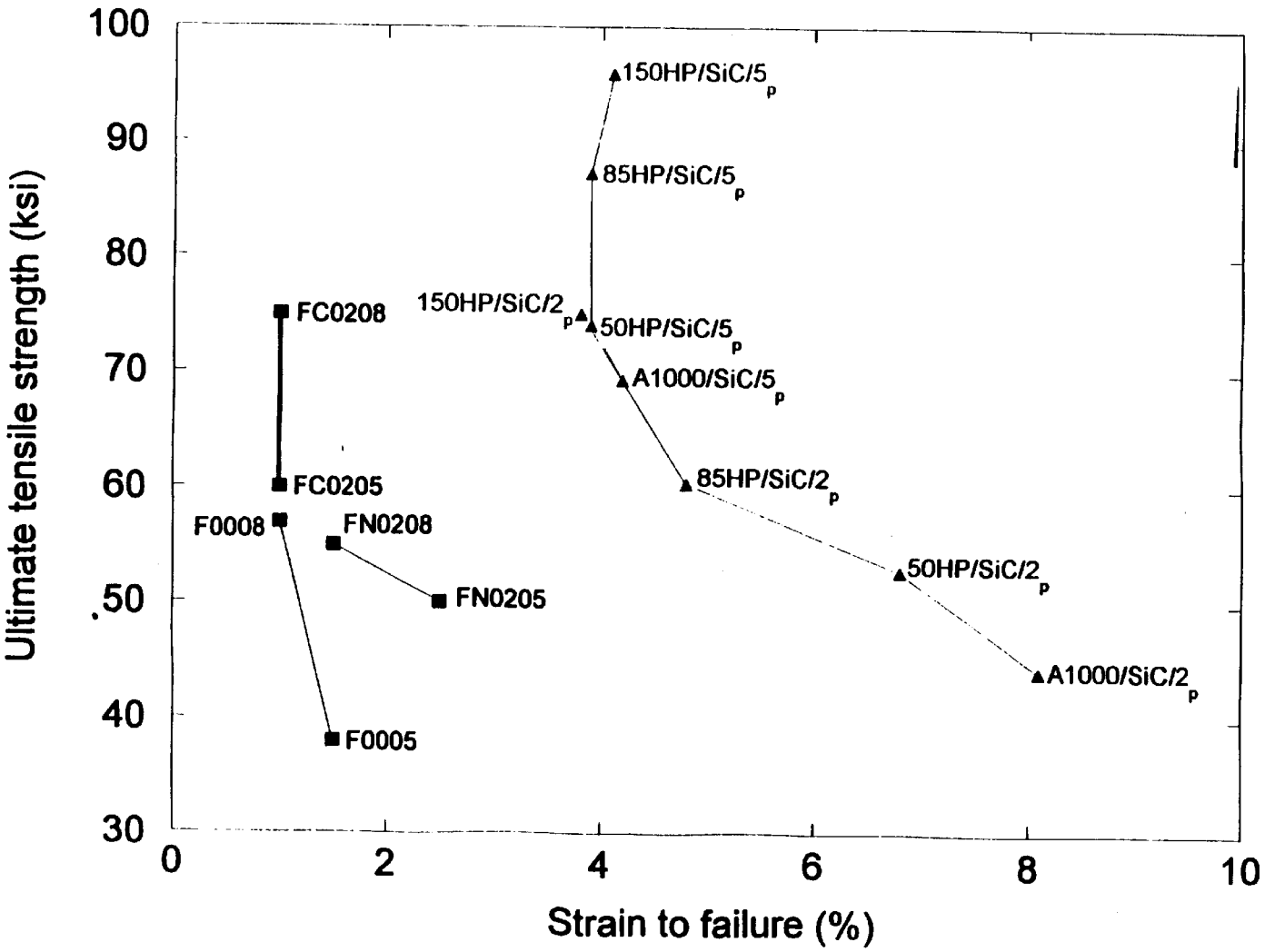
FIG. 1 is a graph presenting results of testing conducted on parts made in accordance with the present invention in comparison to parts made using prior art compositions.

The present invention relates to improved metallurgical powder compositions, methods for the preparation oft hose compositions, and methods for using those compositions to make compacted parts. The present invention also relates to the compacted parts prepared by the methods described below. The powder compositions comprise a powder metallurgy base metal powder, such as an iron-based or nickel-based powder commonly used as the major component of a powder metallurgy powder blend, to which is added or blended silicon carbide, preferably in its powder form, as a strength enhancing alloying powder. The powder compositions can also comprise small amounts of other commonly used alloying powders, such as powders of copper, nickel, and carbon. The powder compositions can similarly be blended with known binding agents, using known techniques, to reduce the segregation and/or dusting of the alloying powders during transportation, storage, and use. The powder compositions can also contain other commonly used components, such as lubricants, etc.

The metallurgical powder compositions of the present invention comprise as a major component one, or a blend of more than one, powder metallurgy base metal powder of the kind generally used in the powder metallurgy industry. For example, such metal powders include iron-based powders and nickel-based powders, particularly such powders prepared by atomization techniques. Preferably, the base metal powder is an iron-based powder.

These metal powders constitute a major portion of the metallurgical powder composition, and generally constitute at least about 85 weight percent, preferably at least about 90 weight percent, and more preferably at least about 95 weight percent of the metallurgical powder composition. Preferably, this base metal powder is an atomized powder, as described in more detail below, such as an iron-based metal powder. The base metal powder can be a mix of an atomized iron powder and a sponge iron, or other type of iron powder. Advantageously, however, the base metal powder contains at least 50 weight percent, preferably at least 75 weight percent, more preferably at least 90 weight percent, and most preferably about 100 weight percent, of an atomized iron based powder.

Examples of "iron-based" powders, as that term is used herein, are powders of substantially pure iron, powders of iron pre-alloyed with other elements (for example, steel-producing elements) that enhance the strength, hardenability, electromagnetic properties, or other desirable properties of the final product, and powders of iron to which such other elements have been diffusion bonded. It is particularly preferred to use an atomized iron-based powder for the compositions of the present invention to be admixed with silicon carbide.

Substantially pure iron powders that can be used in the invention are powders of iron containing not more than about 1.0% by weight, preferably no more than about 0.5% by weight, of normal impurities. These substantially pure iron powders are preferably atomized powders prepared by atomization techniques. Examples of such highly compressible, metallurgical-grade iron powders are the ANCORSTEEL 1000 series of pure iron powders, e.g. 1000, 1000B, and 1000C, available from Hoeganaes Corporation, Riverton, N.J. For example, ANCORSTEEL 1000 iron powder, has a typical screen profile of about 22% by weight of the particles below a No. 325 sieve (U.S. series) and about 10% by weight of the particles larger than a No. 100 sieve with the remainder between these two sizes (trace amounts larger than No. 60 sieve). The ANCORSTEEL 1000 powder has an apparent density of from about 2.85–3.00 g/cm$^3$, typically 2.94 g/cm$^3$. Other substantially pure iron powders that can be used in the invention are typical sponge iron powders, such as Hoeganaes'ANCOR MH-100 powder.

The iron-based powder can incorporate one or more alloying elements that enhance the mechanical or other properties of the final metal part. Such iron-based powders can be powders of iron, preferably substantially pure iron, that has been pre-alloyed with one or more such elements. The pre-alloyed powders can be prepared by making a melt of iron and the desired alloying elements, and then atomizing the melt, whereby the atomized droplets form the powder upon solidification.

Examples of alloying elements that can be pre-alloyed with the iron powder include, but are not limited to, molybdenum, manganese, magnesium, chromium, silicon, copper, nickel, gold, vanadium, columbium (niobium), graphite, phosphorus, aluminum, and combinations thereof. The amount of the alloying element or elements incorporated depends upon the properties desired in the final metal part. Pre-alloyed iron powders that incorporate such alloying elements are available from Hoeganaes Corp. as part of its ANCORSTEEL line of powders.

A further example of iron-based powders are diffusion-bonded iron-based powders which are particles of substantially pure iron that have a layer or coating of one or more other alloying elements or metals, such as steel-producing elements, diffused into their outer surfaces. A typical process for making such powders is to atomize a melt of iron and then combine this atomized powder with the alloying powders and anneal this powder mixture in a furnace. Such commercially available powders include DISTALOY 4600A diffusion bonded powder from Hoeganaes Corporation, which contains about 1.8% nickel, about 0.55% molybdenum, and about 1.6% copper, and DISTALOY 4800A diffusion bonded powder from Hoeganaes Corporation, which contains about 4.05% nickel, about 0.55% molybdenum, and about 1.6% copper.

A preferred iron-based powder is one of iron pre-alloyed with molybdenum (Mo). The powder is produced by atomizing a melt of substantially pure iron containing from about 0.5 to about 2.5 weight percent molybdenum. An example of such a powder is Hoeganaes'ANCORSTEEL 85HP steel powder, which contains about 0.85 weight percent Mo, less than about 0.4 weight percent, in total, of such other materials as manganese, chromium, silicon, copper, nickel, molybdenum or aluminum, and less than about 0.02 weight percent carbon. Other analogs include ANCORSTEEL 50HP and 150HP, which have similar compositions to the 85HP powder, except that they contain 0.5 and 1.5% molybdenum, respectively. Another example of such a powder is Hoeganaes'ANCORSTEEL 4600V steel powder, which contains about 0.5–0.6 weight percent molybdenum, about 1.5–2.0 weight percent nickel, and about 0.1–25 weight percent manganese, and less than about 0.02 weight percent carbon.

Another pre-alloyed iron-based powder that can be used in the invention is disclosed in U.S. Pat. No. 5,108,493, entitled "Steel Powder Admixture Having Distinct Pre-alloyed Powder of Iron Alloys," which is herein incorporated in its entirety. This steel powder composition is an admixture of two different pre-alloyed iron-based powders, one being a pre-alloy of iron with 0.5–2.5 weight percent molybdenum, the other being a pre-alloy of iron with carbon and with at least about 25 weight percent of a transition element component, wherein this component comprises at least one element selected from the group consisting of chromium, manganese, vanadium, and columbium. The admixture is in proportions that provide at least about 0.05 weight percent of the transition element component to the steel powder composition. An example of such a powder is commercially available as Hoeganaes'ANCORSTEEL 41 AB steel powder, which contains about 0.85 weight percent molybdenum, about 1 weight percent nickel, about 0.9 weight percent manganese, about 0.75 weight percent chromium, and about 0.5 weight percent carbon.

Whether in a pre-alloyed or diffusion-bonded iron-based powder, the alloying elements are present in an amount that depends on the properties desired of the final sintered part. Generally, the amount of the alloying elements will be relatively minor, up to about 5% by weight of the total powder composition weight, although as much as 10–15% by weight can be used in certain applications. A preferred range is typically between 0.25 and 4% by weight.

Other iron-based powders that are useful in the practice of the invention are ferromagnetic powders. An example is a powder of iron pre-alloyed with small amounts of phosphorus.

The iron-based powders that are useful in the practice of the invention also include stainless steel powders. These stainless steel powders are commercially available in various grades in the Hoeganaes ANCOR® series, such as the ANCOR® 303L, 304L, 316L, 410L, 430L, 434L, and 409Cb powders. Also, iron-based powders include tool steels made by the powder metallurgy method.

The particles of the iron-based powders, such as the substantially pure iron, diffusion bonded iron, and pre-alloyed iron, have a distribution of particle sizes. Typically, these powders are such that at least about 90% by weight of the powder sample can pass through a No. 45 sieve (U.S. series), and more preferably at least about 90% by weight of the powder sample can pass through a No. 60 sieve. These powders typically have at least about 50% by weight of the powder passing through a No. 70 sieve and retained above or larger than a No.400 sieve, more preferably at least about 50% by weight of the powder passing through a No. 70 sieve and retained above or larger than a No. 325 sieve. Also, these powders typically have at least about 5 weight percent, more commonly at least about 10 weight percent, and generally at least about 15 weight percent of the particles passing through a No. 325 sieve. As such, these powders can have a weight average particle size as small as one micron or below, or tip to about 850–1,000 microns, but generally the particles will have a weight average particle size in the range of about 10–500 microns. Preferred are iron or pre-alloyed iron particles having a maximum weight average particle size up to about 350 microns; more preferably the particles will have a weight average particle size in the range of about 25–150 microns, and most preferably 80–150 microns. Reference is made to MPIF Standard 05 for sieve analysis. In another embodiment, the particle size of these powders can be relatively low. At these lower particle size ranges, the particle size distribution can be analyzed by laser light scattering technology as opposed to screening techniques. Laser light scattering technology reports the particle size distribution in $d_x$, values, where it is said that "x" percent by volume of the powder has a diameter below the reported value. The iron-based powders can have particle size distributions, for example, in the range of having a $d_{50}$ value of between about 1–50, preferably between about 1–25, more preferably between about 5–20, and even more preferably between about 10–20 microns, for use in applications requiring such low particle size powders, e.g., use in metal injection molding applications.

The metal powder used as the major component in the present invention, in addition to iron-based powders, can also include nickel-based powders. Examples of "nickel-based" powders, as that term is used herein, are powders of substantially pure nickel, and powders of nickel pre-alloyed with other elements that enhance the strength, hardenability, electromagnetic properties, or other desirable properties of the final product. The nickel-based powders can be admixed with any of the alloying powders mentioned previously with respect to the iron-based powders. Examples of nickel-based powders include those commercially available as the Hoeganaes ANCORSPRAY® powders such as the N-70/30 Cu, N-80/20, and N-20 powders. These powders have particle size distributions similar to the iron-based powders. Preferred nickel-based powders are those made by an atomization process.

The described iron-based powders that constitute the base metal powder, or at least a major amount thereof, are, as noted above, preferably atomized powders. These iron-based powders have apparent densities of at least 2.75, preferably between 2.75 and 4.6, more preferably between 2.8 and 4.0, and in some cases more preferably between 2.8 and 3.5 g/cm$^3$.

Silicon carbide is added to or blended with either one or more of the above described base metal powders, such as the iron-based powders. The addition of silicon carbide has been found, surprisingly, to dramatically increase the strength and ductility of compacts made from the powder compositions, particularly when increased sintering temperatures are used during the processing, without a significant effect on the dimensional change of the product. The use of silicon carbide greatly diminishes, and in some cases totally obviates, the need to use additional strength enhancing alloying elements such as copper, nickel, manganese, graphite, etc.

It is preferred to add the silicon carbide in the form of a silicon carbide-containing powder. Such a powder form is used herein to refer to and include such shapes as angular, rectangular, needle-shaped, spherical, and any other forms. The amount of silicon carbide used in the metallurgical powder composition can range from about 0.05 to about 7.5, preferably from about 0.25 to about 5, and more preferably from about 0.5 to about 5, and in some cases from about 1 to about 5, percent by weight. Pure silicon carbide, SiC, contains about 70% silicon and 30% carbon, by weight, and accordingly, the amount of silicon used ranges from about 0.035 to about 5.3, preferably from about 0.17 to about 3.5, and more preferably from about 0.35 to about 3.5, and in some cases from about 0.7 to about 3.5, percent by weight, with carbon constituting basically the difference, that is, from about 0.015 to about 2.2, preferably from about 0.075 to about 1.5, more preferably from about 0.15 to about 1.5, and in some cases from about 0.3 to about 1.5 percent by weight.

The particle size of the silicon carbide containing powder is generally relatively small and is analyzed by laser light scattering technology as opposed to screening techniques. Laser light scattering technology reports the particle size distribution in $d_x$ values, where it is said that "x" percent by volume of the powder has a diameter below the reported value. The particle size distribution of the silicon carbide containing powder used in the present invention preferably is such that it has a $d_{90}$ value of below about 100 microns, more preferably below about 75 microns, and even more preferably below about 50 microns. These silicon carbide containing powders preferably have a $d_{50}$ value of below about 75 microns, more preferably below about 50 microns, and even more preferably below about 25 microns, and as low as below about 10microns. In another embodiment, the silicon carbide containing powder can have a relatively coarser particle size distribution, such that at least about 90% by weight of the powder passes through a 100 mesh sieve, and more preferably at least about 90% by weight of the powder passes through a 200 mesh sieve. The silicon carbide containing powder is preferably a high grade, high purity powder, having a purity level (silicon carbide content) in excess of about 90, more preferably in excess of about 95, and even more preferably in excess of about 98, percent by weight.

It is preferred to blend the silicon carbide-containing powder into the metallurgical powder composition in the form of silicon carbide. The present invention, however, can also be practiced by first either blending, prealloying, or bonding by any means the silicon carbide with any other powder component of the metallurgical powder. That is, the silicon carbide can also be added as a binary, tertiary, etc. alloy powder with other alloying elements or powders. For example, the silicon carbide can be first combined with another alloying powder and this combined powder can then be blended with the metal powder, e.g., an iron-based powder, to form the metallurgical composition with the addition of any other optional alloying powders, binding agents, lubricants, etc., as discussed below. In addition, the silicon carbide-containing powder can be bonded to the metal-based powder, such as the iron-based powder, by way of a conventional diffusion bonding process. In such a diffusion bonding process, the iron-based powder and the silicon carbide-containing powder are combined and subjected to temperatures of between about 800–1000° C. to bond the powders together.

The metallurgical powder compositions of the present invention can also include a minor amount of an alloying powder. As used herein, "alloying powders" refers to materials that are capable of diffusing into the iron-based or nickel-based materials upon sintering. The alloying powders that can be admixed with metal powders, e.g., iron-based or nickel-based powders, of the kind described above are those known in the metallurgical powder field to enhance the strength, hardenability, electromagnetic properties, or other desirable properties of the final sintered product. Steel-producing elements are among the best known of these materials. Specific examples of alloying materials include, but are not limited to, elemental molybdenum, manganese, chromium, silicon, copper, nickel, tin, vanadium, columbium (niobium), metallurgical carbon (graphite), phosphorus, aluminum, sulfur, and combinations thereof Other suitable alloying materials are binary alloys of copper with tin or phosphorus; ferro-alloys of iron with manganese, chromium, boron, phosphorus, or silicon; low-melting ternary and quaternary eutectics of carbon and two or three of iron, vanadium, manganese, chromium, and molybdenum; carbides of tungsten or silicon; silicon nitride; and sulfides of manganese or molybdenum. These alloying powders are in the form of particles that are generally of finer size than the particles of metal powder with which they are admixed. The alloying particles generally have a particle size distribution such that they have a dgo value of below about 100 microns, preferably below about 75 microns, and more preferably below about 50 microns; and a $d_{50}$ value of below about 75 microns, preferably below about 50 microns, and more preferably below about 30 microns. The amount of alloying powder present in the composition will depend on the properties desired of the final sintered part. Generally the amount will be minor, up to about 5% by weight of the total powder composition weight, although as much as 10–15% by weight can be present for certain specialized powders. A preferred range suitable for most applications is about 0.25–4.0% by weight. Particularly preferred alloying elements for use in the present invention for certain applications are copper and nickel, which can be used individually at levels of about 0.25–4% by weight, and can also be used in combination.

The metallurgical powder compositions can also contain a lubricant powder to reduce the ejection forces when the compacted part is removed from the compaction die cavity. Examples of such lubricants include stearate compounds, such as lithium, zinc, manganese, and calcium stearates, waxes such as ethylene bis-stearamides, polyethylene wax, and polyolefins, and mixtures of these types of lubricants. Other lubricants include those containing a polyether compound such as is described in U.S. Pat. No. 5,498,276 to Luk, and those useful at higher compaction temperatures described in U.S. Pat. No. 5,368,630 to Luk, in addition to those disclosed in U.S. Pat. No. 5,330,792 to Johnson et al., all of which are incorporated herein in their entireties by reference.

The lubricant is generally added in an amount of up to about 2.0 weight percent, preferably from about 0.1 to about 1.5 weight percent, more preferably from about 0.1 to about 1.0 weight percent, and most preferably from about 0.2 to about 0.75 weight percent, of the metallurgical powder composition.

The components of the metallurgical powder compositions of the invention can be prepared following conventional powder metallurgy techniques. Generally, the metal powder, silicon carbon powder, and optionally the solid lubricant and additional alloying powders (along with any other used additive) are admixed together using conventional powder metallurgy techniques, such as the use of a double cone blender. The blended powder composition is then ready for use.

The metallurgical powder composition may also contain one or more binding agents, particularly where an additional, separate alloying powder is used, to bond the different components present in the metallurgical powder composition so as to inhibit segregation and to reduce dusting. By "bond" as used herein, it is meant any physical or chemical method that facilitates adhesion of the components of the metallurgical powder composition.

In a preferred embodiment of the present invention, bonding is carried out through the use of at least one binding agent. Binding agents that can be used in the present invention are those commonly employed in the powder metallurgical arts. For example, such binding agents include those found in U.S. Pat. No. 4,834,800 to Semel, U.S. Pat. No. 4,483,905 to Engstrom, U.S. Pat. No. 5,298,055 to Semel et.al., and in U.S. Pat. No. 5,368,630 to Luk, the disclosures of which are hereby incorporated by reference in their entireties.

Such binding agents include, for example, polyglycols such as polyethylene glycol or polypropylene glycol; glycerine; polyvinyl alcohol; homopolymers or copolymers of vinyl acetate; cellulosic ester or ether resins; methacrylate polymers or copolymers; alkyd resins; polyurethane resins; polyester resins; or combinations thereof. Other examples of binding agents that are useful are the relatively high molecular weight polyalkylene oxide-based compositions described in U.S. Pat. No. 5,298,055 to Semel et al. Useful binding agents also include the dibasic organic acid, such as azelaic acid, and one or more polar components such as polyethers (liquid or solid) and acrylic resins as disclosed in U.S. Pat. No. 5,290,336 to Luk, which is incorporated herein by reference in its entirety. The binding agents in the '336 Patent to Luk can also act advantageously as a combination of binder and lubricant. Additional useful binding agents include the cellulose ester resins, hydroxy alkylcellulose resins, and thermoplastic phenolic resins described in U.S. Pat. No. 5,368,630 to Luk.

The binding agent can further be the low melting, solid polymers or waxes, e.g., a polymer or wax having a softening temperature of below 200° C. (390° F.), such as polyesters, polyethylenes, epoxies, urethanes, paraffins, ethylene bisstearamides, and cotton seed waxes, and also polyolefins with weight average molecular weights below 3,000, and hydrogenated vegetable oils that are $C_{14-24}$ alkyl moiety triglycerides and derivatives thereof, including hydrogenated derivatives, e.g. cottonseed oil, soybean oil, jojoba oil, and blends thereof, as described in WO 99/20689, published Apr. 29, 1999, which is hereby incorporated by reference in its entirety herein. These binding agents can be applied by the dry bonding techniques discussed in that application and in the general amounts set forth above for binding agents. Further binding agents that can be used in the present invention are polyvinyl pyrrolidone as disclosed in U. S. Pat. No. 5,069,714, which is incorporated herein in its entirety by reference, or tall oil esters.

The amount of binding agent present in the metallurgical powder composition depends on such factors as the density, particle size distribution and amounts of the iron-alloy powder, the iron powder and optional alloying powder in the metallurgical powder composition. Generally, the binding agent will be added in an amount of at least about 0.005 weight percent, more preferably from about 0.005 weight percent to about 2 weight percent, and most preferably from about 0.05 weight percent to about 1 weight percent, based on the total weight of the metallurgical powder composition.

The metallurgical powder compositions of the present invention containing silicon carbide can be formed into compacted parts using conventional techniques. Typically, the metallurgical powder composition is poured into a die cavity and compacted under pressure, such as between about 5 and about 200 tons per square inch (tsi), more commonly between about 10 and 100 tsi. The compacted part is then ejected from the die cavity.

Conventionally, the compacted ("green") part is then sintered to enhance its strength. In accordance with the present invention, the sintering is advantageously conducted at a temperature of at least 2150° F. (1175° C.), preferably at least about 2200° F. (1200° C.), more preferably at least about 2250° F. (1230° C.), and even more preferably at least about 2300° F. (1260° C.). The sintering operation can also be conducted at lower temperatures, such as at least 2050° F. (1120° C.). The sintering is conducted for a time sufficient to achieve metallurgical bonding and alloying. It is particularly preferred, as shown in the following examples, to sinter the powder composition containing silicon carbide at a temperature that will cause the silicon carbide to diffuse into the iron matrix such that it alloys with the iron. Additional processes such as forging or other appropriate manufacturing technique or secondary operation may be used to produce the finished part. The use of silicon carbide as an alloying element provides compacted parts having relatively high hardness values after sintering. The use of silicon carbide in the manner described, in methods where the sintering step is conducted at elevated temperatures, in many cases negates the need to subject the compacted part to a subsequent heat treatment following the sintering step to improve its hardness properties.

EXAMPLES

The following examples, which are not intended to be limiting, present certain embodiments and advantages of the present invention. Unless otherwise indicated, any percentages are on a weight basis.

Physical properties of powder mixtures and of the green bars were determined generally in accordance with the following test methods and formulas:

| Property | Test Method |
|---|---|
| Green Density (g/cm$^3$) | ASTM B331-76 |
| Green Strength (psi) | ASTM B312-76 |
| Dimensional Change (%) | ASTM B610-76 |
| Transverse Rupture Strength (ksi) | MPIF Std. 41 |
| Ultimate Tensile Strength (ksi) | MPIF Std. 10 |
| Strain To Failure (%) | MPIF Std. 10 |

Example 1

Various levels of silicon carbide were admixed with an iron-based metal powder and compacted and sintered. The resulting parts displayed increased strength with increased silicon carbide content.

The iron-based powder used was Ancorsteel A1000 iron powder (Hoeganaes Corp.), which is a substantially pure iron-based atomized powder. The silicon carbide powder was obtained from Norton Saint-Gobain, and it had a $d_{50}$ value of 10 microns as measured by a MicroTrac II Instrument made by Leeds and Northrup, Horsham, Pa., Model No. 158704. The silicon carbide powder was blended with the A1000 iron powder in various levels, and each composition also contained about 0.75% by weight Acrawax, which is an ethylene bis-stearamide wax lubricant. A binding agent that was a mixture of polyethyleneoxide and polyethylene glycol was used in amounts in relative proportion to the amount of silicon carbide used (0.07% wt. binder for 2% SiC; 0.16% wt. binder for 5% SiC; 0.33% wt. binder for 10% SiC). The compositions were prepared by combining the iron-based powder, the lubricant, and the silicon carbide together, then the binding agent in an acetone solvent was added with mixing, followed by removal of the solvent. The compositions were compacted at 40 tsi into rectangular bars (about 1.5" long, 0.25" high, and 0.5" wide) that were then sintered in a belt furnace in a 25% $N_2$/75% $H_2$ atmosphere (about 30 minutes) and cooled to room temperature.

The compositions and green properties are shown in Table 1.1.

TABLE 1.1

| Volume Fraction SiC (%) | Weight % SiC | Pore-free Green Density (g/cm$^3$) | Green Density (g/cm$^3$) | Fraction of Pore-free Density (%) |
|---|---|---|---|---|
| 0 | 0 | 7.85 | 7.01 | 89.3 |
| 2 | 0.82 | 7.75 | 6.90 | 89.0 |
| 5 | 2.09 | 7.60 | 6.74 | 88.7 |
| 10 | 4.32 | 7.36 | 6.43 | 87.4 |

The properties of the compacts sintered at 2300° F. are shown in Table 1.2.

TABLE 1.2

| Volume Fraction SiC (%) | Pore-free Sintered Density (g/cm$^3$) | Sintered Density (g/cm$^3$) | Fraction of Pore-free Density (%) | Transverse Rupture Strength (ksi) | Dimensional Change (%) |
|---|---|---|---|---|---|
| 0 | 7.90 | 6.99 | 88.5 | 73.9 | −0.15 |
| 2 | 7.81 | 6.91 | 88.5 | 87.8 | −0.06 |
| 5 | 7.67 | 6.74 | 88.1 | 116.5 | −0.06 |
| 10 | 7.43 | 6.93 | 93.3 | 194.3 | −1.37 |

Example 2

The particle size distribution of the iron-based powder can be modified to alter the final of the compacted parts. Four different particle size distributions for the iron-based powder, A1000, were studied with a 10% by volume addition of silicon carbide (same as used in Example 1). The powder compositions were prepared under the same conditions as those used in Example 1, using the same lubricant and binding agent. The particle size distribution for the iron-based powders, determined by Microtrac II unit is shown in Table 2.1

TABLE 2.1

| Material | $d_{10}$ ($\mu$m) | $d_{50}$ ($\mu$m) | $d_{90}$ ($\mu$m) |
|---|---|---|---|
| Small | 28.7 | 47.7 | 77.5 |
| Medium | 38.6 | 92.1 | 189.1 |
| Large | 85.5 | 132.9 | 207.7 |
| Bimodal | 33.1 | 69.7 | 166.7 |

The sintered properties of the powders that were compacted at 40 tsi and sintered under the same conditions of Example 1 are shown in Table 2.2.

TABLE 2.2

| A1000 with 10% vol. SiC | Pore-free sintered density (g/cm$^3$) | Sintered Density (g/cm$^3$) | Fraction of Pore-free Density (g/cm$^3$) | Transverse Rupture Strength (ksi) | Dimensional Change (%) |
|---|---|---|---|---|---|
| Small | 7.43 | 7.02 | 94.5 | 207.8 | −2.52 |
| Medium | 7.43 | 6.66 | 89.6 | 192.5 | −0.70 |
| Large | 7.43 | 6.38 | 85.9 | 183.5 | −0.59 |
| Bimodal | 7.43 | 6.60 | 88.8 | 196.1 | −0.45 |

Example 3

A comparison of ultimate tensile strength versus strain to failure, which is a measure of the ductility of the compacted part, was made between various powder compositions of the present invention and other compositions that did not include silicon carbide. Typically, a generally inverse relationship is obtained between ultimate tensile strength and strain to failure. This experiment shows that the inclusion of silicon carbide in accordance with the present invention provides a higher strain to failure value for a given tensile strength.

Table 3.1 shows the nominal compositions on a weight percent basis for the various blends or mixes used in this experiment.

TABLE 3.1

Nominal Compositions Of Powder Blends

| Powder Blend | Fe (%) | Ni (%) | C (%) | Cu (%) | Mo (%) |
|---|---|---|---|---|---|
| F005 | 99.5 | — | 0.5 | — | — |
| F008 | 99.2 | — | 0.8 | — | — |
| FN0205 | 97.5 | 2 | 0.5 | — | — |
| FN0208 | 97.2 | 2 | 0.8 | — | — |
| FC0205 | 97.5 | — | 0.5 | 2 | — |
| FC0208 | 97.2 | — | 0.8 | 2 | — |
| A1000 | 100 | — | — | — | — |
| 50HP | 99.5 | — | — | — | 0.5 |
| 85HP | 99.15 | — | — | — | 0.85 |
| 150HP | 98.5 | — | — | — | 1.5 |

A1000, 50HP, 85HP, and 150HP are all Ancorsteel grade powders from Hoeganaes Corporation, Riverton, N.J. These powders were blended with silicon carbide powder (same as used in Example 1) at levels of two (2 p) and five (5 p) volume percent. These various mixes were also blended with a lubricant and binding agent as per the conditions set forth in Example 1. These various powder compositions were compacted at 40 tsi and subsequently sintered at 2300° F. for 30 minutes as in Example 1. The compacted parts were then tested for ultimate tensile strength (ksi) and strain to failure (%).

The results of the testing are shown in FIG. 1. The data for the F-series compositions was taken from MPIF-35 standard data from Materials Standards for P/M Parts (Metal Powder Industry Federation, 1997).

Example 4

A comparison between the addition of silicon carbide to separate additions of silicon and graphite (carbon) was made to demonstrate the unexpected superiority of the use of silicon carbide as an alloying material to the use of the individual components, silicon and carbon, as alloying materials.

The base metallurgical powder used for this example was the A1000 powder used in Example 1. The inventive composition admixed with the A1000 powder 5 volume percent SiC (2.09% wt.) powder as used in Example 1 along with 0.75% by weight Acrawax lubricant. The iron-based powder, silicon carbon powder, and lubricant were blended together and then about 0.16% wt. binding agent, a mixture of polyethyleneoxide and polyethylene glycol, dissolved in an acetone solvent, was added and mixed to form the final composition after evaporation of the solvent. The comparative powder was prepared in a similar fashion, except that the silicon carbide powder was replaced with 1.46% wt. silicon powder and 0.63% wt. graphite powder.

Experimental bars were compacted under a compaction pressure of 40 tsi. The green density of the SiC specimen was 6.74 g/cm$^3$ and for the Si+C specimen it was 6.70 g/cm$^3$. The specimens were sintered for about 30 minutes in a belt furnace at 2300° F. in a 25% $N_2$/75% $H_2$ atmosphere and cooled to room temperature. The sintered properties are set forth in Table 4.1. The silicon carbide addition provided a superior strength product with significantly less dimensional change in the product following the sintering operation.

TABLE 4.1

| Test/Specimen | 2.09% wt. SiC | 1.46% wt. Si + 0.63% wt. C |
|---|---|---|
| Sintered Density (g/cm$^3$) | 6.76 | 6.81 |
| TRS (ksi) | 124.9 | 117.5 |
| Dimensional Change (%) | −0.08 | −0.42 |
| Hardness (HRA) | 42.5 | 42.7 |
| Yield Strength (ksi) | 48.7 | 44.9 |
| Ultimate Strength (ksi) | 72.2 | 66.8 |
| Strain to Failure (%) | 4.04 | 3.96 |

What is claimed is:

1. An improved metallurgical powder composition, comprising:

(a) at least about 85 percent by weight of a base metal powder comprising at least 50 percent by weight atomized iron-based powder having an apparent density of between 2.75 and 4.6 g/cm$^3$; and (b) from about 0.05 to about 2.1 percent by weight silicon carbide, wherein the total carbon content of the powder composition is between about 0.015 and about 0.63 percent by weight.

2. The metallurgical powder composition of claim 1, wherein the base metal powder comprises at least 75 percent by weight atomized iron-based powder having an apparent density of between 2.75 and 4.6 g/cm$^3$.

3. The metallurgical powder composition of claim 1, wherein the base metal powder comprises at least 90 percent by weight atomized iron-based powder having an apparent density of between 2.75 and 4.6 g/cm$^3$.

4. The metallurgical powder composition of claim 1, wherein the silicon carbide is present in an amount of between 0.25 and 2.1 percent by weight.

5. The metallurgical powder composition of claim 4, wherein the base metal powder comprises at least 90 percent by weight atomized iron-based powder having an apparent density of between 2.75 and 4.6 g/cm$^3$.

6. The metallurgical powder composition of claim 5, wherein the atomized iron-based powder has a particle size distribution such that about 50 percent by weight of the iron-based powder passes through a No. 70 sieve and is retained on or above a No. 400 sieve.

7. An improved metallurgical powder composition, comprising:

(a) at least about 85 percent by weight of a base metal powder comprising at least 50 percent by weight atomized iron-based powder, the iron-based powder being substantially pure iron powder and having an apparent density of between 2.75 and 4.6 g/cm$^3$; and (b) silicon carbide-containing powder present in an amount to provide from about 0.05 to about 7.5 percent by weight silicon carbide.

8. The metallurgical powder composition of claim 7, wherein the silicon carbide-containing powder has a particle size distribution such that it has a $d_{50}$ value of below about 50 microns.

9. The metallurgical powder composition of claim 7, wherein the base metal powder comprises at least 75 percent by weight atomized iron-based powder having an apparent density of between 2.75 and 4.6 g/cm$^3$.

10. The metallurgical powder composition of claim 9, wherein the silicon carbide-containing powder has a particle size distribution such that it has a $d_{50}$ value of below about 50 microns.

11. The metallurgical powder composition of claim 7, wherein the base metal powder comprises at least 90 percent by weight atomized iron-based powder having an apparent density of between 2.75 and 4.6 g/cm$^3$.

12. The metallurgical powder composition of claim 11, wherein the silicon carbide-containing powder has a particle size distribution such that it has a $d_{50}$ value of below about 50 microns.

13. The metallurgical powder composition of claim 12, wherein the atomized iron-based powder has a particle size distribution such that about 50 percent by weight of the iron-based powder passes through a No. 70 sieve and is retained above a No. 400 sieve.

14. A method of preparing an improved metallurgical powder composition, comprising the steps of:

(a) providing an atomized iron-based powder having a particle size distribution such that about 50% by weight of the iron-based powder passes through a No. 70 sieve and is retained on or above a No. 400 sieve, and having an apparent density of between 2.75 and 4.6 g/cm$^3$; and (b) blending with the atomized iron-based powder silicon carbide-containing powder in an amount such that the metallurgical powder composition comprises from about 0.05 to about 2.1 percent by weight silicon carbide, wherein the total carbon content of the powder composition is between about 0.015 and about 0.63 percent by weight.

15. The method of claim 14 wherein the iron-based powder is present in the metallurgical powder composition in an amount of at least about 85 percent by weight.

16. The method of claim 15 wherein the silicon carbide-containing powder has a particle size distribution such that it has a $d_{50}$ value of below about 50 microns.

17. A method for forming a compacted metal part from a powder metallurgical composition, comprising the steps of:

(a) providing an improved metallurgical powder composition, comprising:

(i) at least about 85 percent by weight of an atomized iron-based powder having an apparent density of between 2.75 and 4.6 g/cm$^3$; and (ii) from about 0.05 to about 2.1 percent by weight silicon carbide, wherein the total carbon content of the powder composition is between about 0.015 and about 0.63 percent by weight;

(b) compacting the metallurgical powder composition in a die at a pressure of between about 5 and 200 tsi to form a compacted part; and (c) sintering the compact part at a temperature of at least 2150° F.

18. The method of claim 17 wherein the sintering step is conducted at a temperature of at least 2200° F.

19. The method of claim 17 wherein the sintering step is conducted at a temperature of at least 2250° F.

20. The method of claim 17 wherein the sintering step is conducted at a temperature of at least 2300° F.

21. The method of claim 17 wherein the silicon carbide is present in the metallurgical powder composition as a silicon carbide-containing powder having a particle size distribution such that the silicon carbide-containing powder has a $d_{50}$ value of below about 50 microns.

22. The method of claim 21 wherein the sintering step is conducted at a temperature of at least 2200° F.

23. The method of claim 21 wherein the sintering step is conducted at a temperature of at least 2250° F.

24. The method of claim 21 wherein the sintering step is conducted at a temperature of at least 2300° F.

25. The method of claim 17 wherein the silicon carbide is present in the metallurgical powder composition in a form such that the silicon carbide provides between about 0.035 and about 1.5 percent by weight silicon to the powder composition and provides between about 0.015 and about 0.63 percent by weight carbon to the powder composition.

26. The method of claim 25 wherein the sintering step is conducted at a temperature of at least 2200° F.

27. The method of claim 25 wherein the sintering step is conducted at a temperature of at least 2250° F.

28. The method of claim 25 wherein the sintering step is conducted at a temperature of at least 2300° F.

29. The method of claim 14 wherein the silicon carbide is present in the metallurgical powder composition in a form such that the silicon carbide provides between about 0.035 and about 1.5 percent by weight silicon to the powder composition and provides between about 0.015 and about 0.63 percent by weight carbon to the powder composition.

30. The composition of claim 7 wherein the silicon carbide is present in the composition in an amount of from about 0.05 to about 2.1 percent by weight and the total carbon content of the powder composition is between about 0.015 and about 0.63 percent by weight.

31. The metallurgical powder composition of claim 30 wherein the silicon carbide is present in the metallurgical powder composition to provide between about 0.035 and about 1.5 percent by weight silicon to the powder composition and between about 0.015 and about 0.63 percent by weight carbon to the powder composition.

32. The metallurgical powder composition of claim 1 wherein the silicon carbide is present in the metallurgical powder composition to provide between about 0.035 and about 1.5 percent by weight silicon to the powder composition and between about 0.015 and about 0.63 percent by weight carbon to the powder composition.

33. The composition of claim 1 wherein the silicon carbide is a powder having a particle size distribution such that it has a $d_{50}$ value of below about 25 microns.

34. The composition of claim 1 wherein the silicon carbide is a powder having a particle size distribution such that it has a $d_{50}$ value of below about 10 microns.

35. The composition of claim 3 wherein the silicon carbide is a powder having a particle size distribution such that it has a $d_{50}$ value of below about 10 microns.

36. The composition of claim 9 wherein the silicon carbide-containing powder having a particle size distribution such that it has a $d_{50}$ value of below about 10 microns.

37. The method of claim 15 wherein the silicon carbide-containing powder has a particle size distribution such that it has a $d_{50}$ value of below about 10 microns.

38. The method of claim 17 wherein the silicon carbide is a powder having a particle size distribution such that it has a $d_{50}$ value of below about 10 microns.

39. The method of claim 25 wherein the silicon carbide is a powder having a particle size distribution such that it has a $d_{50}$ value of below about 10 microns.

* * * * *

UNITED STATES PATENT AND TRADEMARK OFFICE

CERTIFICATE OF CORRECTION

PATENT NO. : 6,364,927 B1 
DATED : April 2, 2002
INVENTOR(S) : Kalathur S. Narasimhan and Nikhilesh Chawla It is certified that error appears in the above-identified patent and that said Letters Patent is hereby corrected as shown below:

Column 3,
Line 15, "oft hose" should read -- of those --

Column 8,
Line 6, "dgo" should read -- $d_{90}$ --

Signed and Sealed this

Eleventh Day of June, 2002

*Attest:*

*Attesting Officer*

JAMES E. ROGAN
*Director of the United States Patent and Trademark Office*